US010059545B1

(12) United States Patent
Chen

(10) Patent No.: US 10,059,545 B1
(45) Date of Patent: Aug. 28, 2018

(54) ROLLER-TYPE LATERAL FORCE GENERATION DEVICE

(71) Applicant: Teco Image Systems Co., Ltd., Taipei (TW)

(72) Inventor: Chien-Min Chen, Taipei (TW)

(73) Assignee: TECO IMAGE SYSTEMS CO., LTD., Taipei (TW)

( * ) Notice: Subject to any disclaimer, the term of this patent is extended or adjusted under 35 U.S.C. 154(b) by 0 days.

(21) Appl. No.: 15/827,496

(22) Filed: Nov. 30, 2017

(30) Foreign Application Priority Data

Sep. 22, 2017 (TW) ..... 106132519 A

(51) Int. Cl.
*B65H 5/06* (2006.01)
*B65H 9/16* (2006.01)

(52) U.S. Cl.
CPC ..... *B65H 5/062* (2013.01); *B65H 5/06* (2013.01); *B65H 9/166* (2013.01); *B65H 2301/443243* (2013.01); *B65H 2301/51252* (2013.01); *B65H 2301/512422* (2013.01); *B65H 2404/1345* (2013.01); *B65H 2404/1452* (2013.01); *B65H 2404/15212* (2013.01); *B65H 2511/172* (2013.01); *B65H 2515/312* (2013.01)

(58) Field of Classification Search
CPC ..... B65H 5/06; B65H 5/062; B65H 9/166; B65H 2301/443243; B65H 2301/512422; B65H 2301/51252; B65H 2404/1345; B65H 2404/1452; B65H 2404/15212; B65H 2511/172; B65H 2515/312
See application file for complete search history.

(56) References Cited

U.S. PATENT DOCUMENTS 7,300,054 B2 * 11/2007 Suga ..... B65H 5/062 271/228
7,684,749 B2 * 3/2010 Yamane ..... B65H 9/002 271/226
8,919,772 B2 * 12/2014 Okumura ..... B65H 5/062 271/251

(Continued)

FOREIGN PATENT DOCUMENTS

CN 102666328 A 9/2012
CN 103569724 A 2/2014

(Continued)

*Primary Examiner* — Jeremy R Severson
(74) *Attorney, Agent, or Firm* — Kirton McConkie; Evan R. Witt

(57) ABSTRACT

A roller-type lateral force generation device includes a roller, a first plate, a second plate, a connection plate, a first spring, a rotation shaft, a second spring, a fixing element and an adjustment element. The connection plate is disposed along a set direction, which is perpendicular to a paper-feeding direction. The first spring is disposed between the first plate and a first shaft portion of a roller shaft of the roller. The second spring is disposed between the second plate and a second shaft portion of the roller shaft. The adjustment element has a limitation plate perpendicular to the first plate. The limitation plate has a limitation groove. The first shaft portion is penetrated through the limitation groove. The set direction and the connection line of the rotation shaft and the roller shaft have an angle larger than 0 degree. A lateral force is generated, thereby avoiding paper squeezing inward.

10 Claims, 10 Drawing Sheets

(56) References Cited

U.S. PATENT DOCUMENTS

| | | | | |
|---|---|---|---|---|
| 2004/0135310 | A1* | 7/2004 | Yang | B65H 9/166 271/226 |
| 2007/0037683 | A1 | 2/2007 | Schmieder | |
| 2009/0060609 | A1* | 3/2009 | Watanabe | G03G 15/6567 399/395 |
| 2016/0089914 | A1* | 3/2016 | Yamamoto | B41J 2/01 347/102 |

FOREIGN PATENT DOCUMENTS

| | | | | |
|---|---|---|---|---|
| EP | 1493567 | A1 | | 1/2005 |
| JP | 61002642 | A | * | 1/1986 |
| TW | 200711972 | A | | 4/2007 |
| TW | 200827184 | A | | 7/2008 |
| TW | 200909222 | A | | 3/2009 |
| TW | 200909328 | A | | 3/2009 |
| TW | 201325918 | A | | 7/2013 |
| TW | 201425054 | A | | 7/2014 |
| WO | 2012140030 | A1 | | 10/2012 |

* cited by examiner

2

2

ROLLER-TYPE LATERAL FORCE GENERATION DEVICE

CROSS-REFERENCE TO RELATED APPLICATION

This application claims priority from Taiwan Patent Application No. 106132519, filed on Sep. 22, 2017, the entire contents of which are incorporated herein by reference for all purposes.

FIELD OF THE INVENTION

The present invention relates to a lateral force generation device, and more particularly to a roller-type lateral force generation device applied to a large print equipment.

BACKGROUND OF THE INVENTION

In a large print equipment, which is for example a large format printer or the like utilizing a roller to transport papers, one of the most popular issues is that a paper may be tilted or shrunk inwardly during transportation that makes the paper stuck or broken. The reason causing those issues may be a bad installation, a bad adjustment or the low precision. Especially, when the rollers of the paper-feeding mechanism, which are respectively located at the left side and the right side, have different feeding rates, the velocities of the left side of the paper and the right side of the paper will be different. If the feeding directions of the left side and the right side of the paper are both tilted inwardly and toward the center of the paper, the paper is easily broken or wrinkled.

Please refer to FIG. 1. FIG. 1 schematically illustrates the paper-feeding mechanism of a conventional print equipment and the paper. As shown in FIG. 1, a paper-feeding mechanism is assembled by two active rollers 11 on the top and two corresponded passive rollers 12 on the bottom. The rotation direction R of the active rollers 11 is clockwise direction. A paper 13 is entered from the right side and rolled in so as to be driven to the left side. At this time, if the geometric shapes, sizes and/or angles of the active rollers 11 and the passive rollers 12 are not ideal enough, the feeding rates or feeding angles of the two sides will be not synchronous. It further causes the paper being tilted or shrunk inwardly and makes the paper stuck or broken.

Please refer to FIG. 2 and FIG. 3. FIG. 2 schematically illustrates the conventional paper-feeding mechanism with a crankshaft installed with active rollers having different diameters and the paper transproted by the active rollers. FIG. 3 schematically illustrates an active roller of the conventional paper-feeding mechanism has different diameters respectively at the left side and the right side and the paper transported by the active roller. The exaggerated diagrams of poor precision or bad assembly are shown in FIG. 2 and FIG. 3. When a plurality of active rollers 11 having different diameters are installed on a shaft 14, the feeding rates of the paper 13 are different (the length of the arrow represents the feeding rate). The bending of the shaft 14 itself also causes the paper to be skewed in the feeding direction. When the same active roller 11 has different diameters respectively at the left side and the right side, the different feeding rates of the left side and the right side of the paper 13 causes the paper to be skewed continuously. In brief, the conventional paper-feeding mechanism usually makes the paper to be tilted and shrunk inwardly and further causes the paper to be broken or wrinkled. Not only being inconvenient, but also wasting the print materials.

Therefore, there is a need of providing an improved roller-type lateral force generation device distinct from the prior art in order to solve the above drawbacks.

SUMMARY OF THE INVENTION

Some embodiments of the present invention are to provide a roller-type lateral force generation device in order to overcome at least one of the above-mentioned drawbacks encountered by the prior arts.

The present invention provides a roller-type lateral force generation device. By disposing the connection plate along the direction of the paper-feeding roller shaft itself (i.e. the set direction), an angular difference is existed between the main body of the roller and the paper-feeding roller shaft, and the lateral force, which is existed in form of friction force, is provided through the angular difference. The paper can be forced outward while being fed forward to prevent inward shrinkage, and further the skewed issue during the paper transport can be solved.

The present invention also provides a roller-type lateral force generation device. Since the main body of the roller is pressed by the first spring and the second spring so as to be contacted with the paper and driven to be rotated, the roller-type lateral force generation device is applied to each type of the present print apparatus without extra power source. The roller-type lateral force generation device with high compatibility can be widely utilized.

In accordance with an aspect of the present invention, there is provided a roller-type lateral force generation device providing a lateral force while a print apparatus transporting a paper along a paper-feeding direction. The roller-type lateral force generation device includes a roller, a first plate, a second plate, a connection plate, a first spring, a rotation shaft, a second spring, a fixing element and an adjustment element. The roller has a main body and a roller shaft. The roller shaft is penetrated through the main body. The roller shaft has a first shaft portion and a second shaft portion respectively at the two sides of the main body. The second shaft portion has a penetration hole. The first plate is disposed above the first shaft portion. The second plate is disposed above the second shaft portion. The second plate has an opening. The opening is corresponded to the penetration hole. The connection plate is connected with the first plate and the second plate. The connection plate is disposed along a set direction, and the set direction is perpendicular to the paper-feeding direction. The first spring is disposed between the first plate and the first shaft portion. The rotation shaft is penetrated through the penetration hole. The second spring is disposed between the second plate and the second shaft portion and sleeved around the rotation shaft. The fixing element is partially penetrated through the opening, the rotation shaft and the second spring. The adjustment element has a limitation plate. The limitation plate is perpendicular to the first plate. The limitation plate has a limitation groove. The first shaft portion is penetrated through the limitation groove. The set direction and a connection line of the rotation shaft and the roller shaft have an angle larger than 0 degree. The main body of the roller is pressed by the elastic power of the first spring and the second spring, so that the lateral force is generated while the paper being fed through the bottom of the roller.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
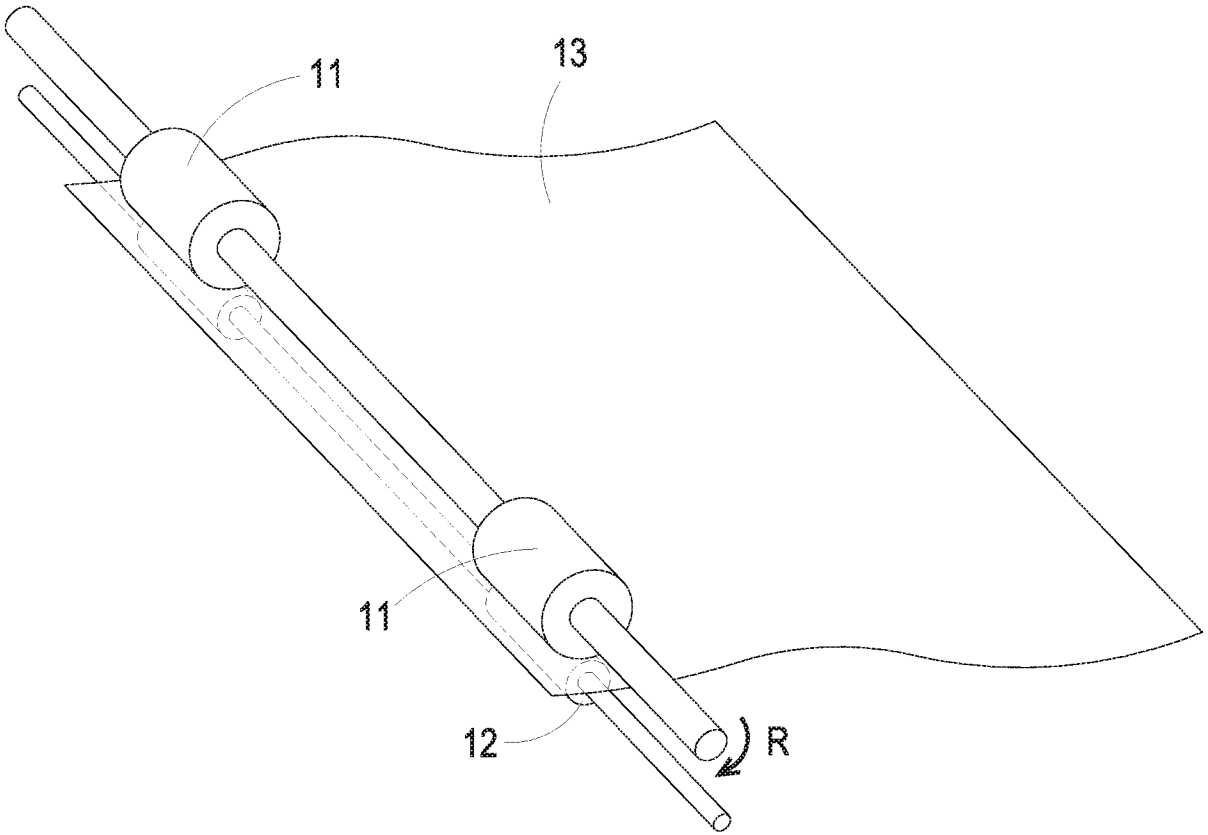
FIG. 1 PRIOR ART
FIG. 1 schematically illustrates the paper-feeding mechanism of a conventional print equipment and the paper.
Figure 3:
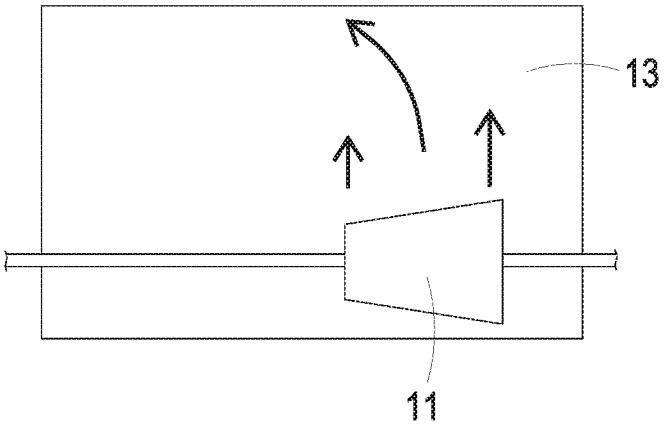
FIG. 3 PRIOR ART
FIG. 3 schematically illustrates an active roller of the conventional paper-feeding mechanism has different diameters respectively at the left side and the right side and the paper transported by the active roller.
Figure 2:
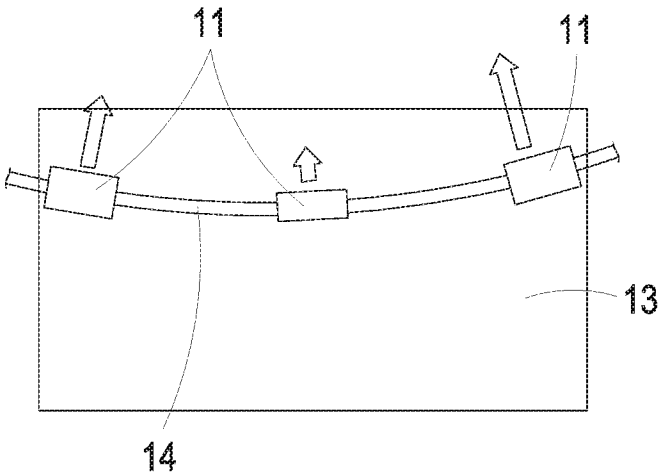
FIG. 2 PRIOR ART
FIG. 2 schematically illustrates the conventional paper-feeding mechanism with a crankshaft installed with active rollers having different diameters and the paper transported by the active rollers.
Figure 4:
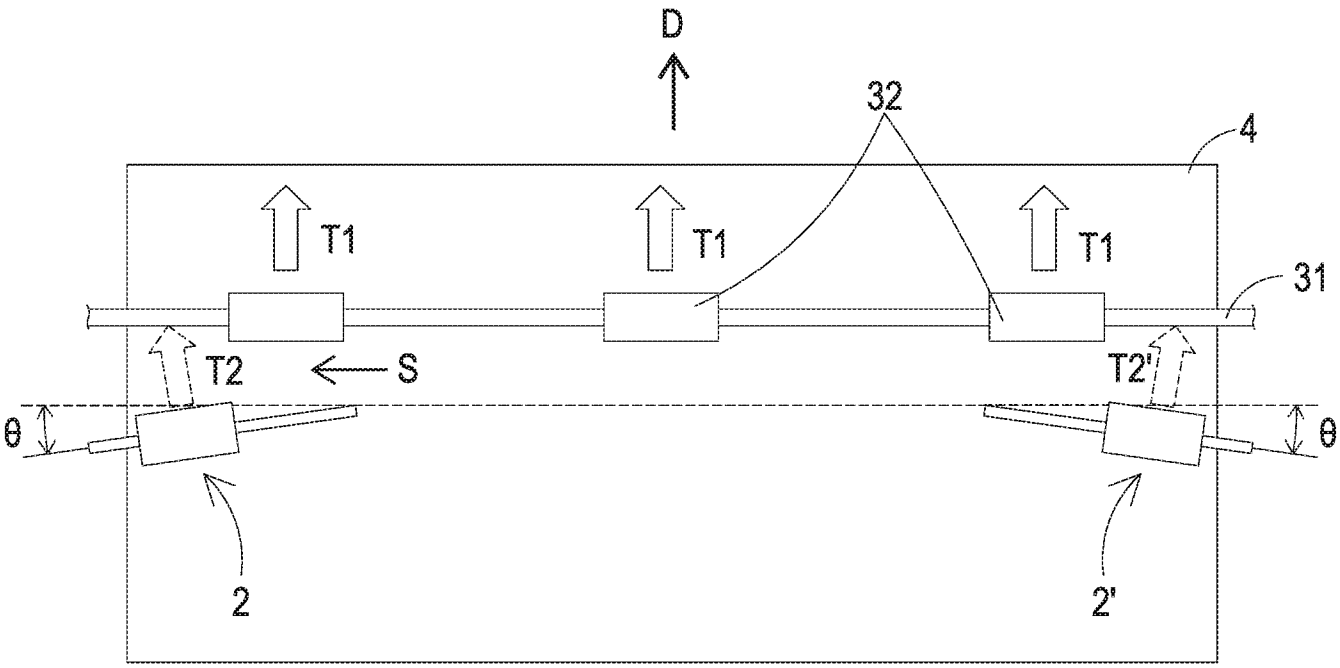
FIG. 4 schematically illustrates the partial structure of a roller-type lateral force generation device and the relation of a paper-feeding roller, a paper-feeding roller shaft, a paper and the transport direction thereof.
Figure 5:
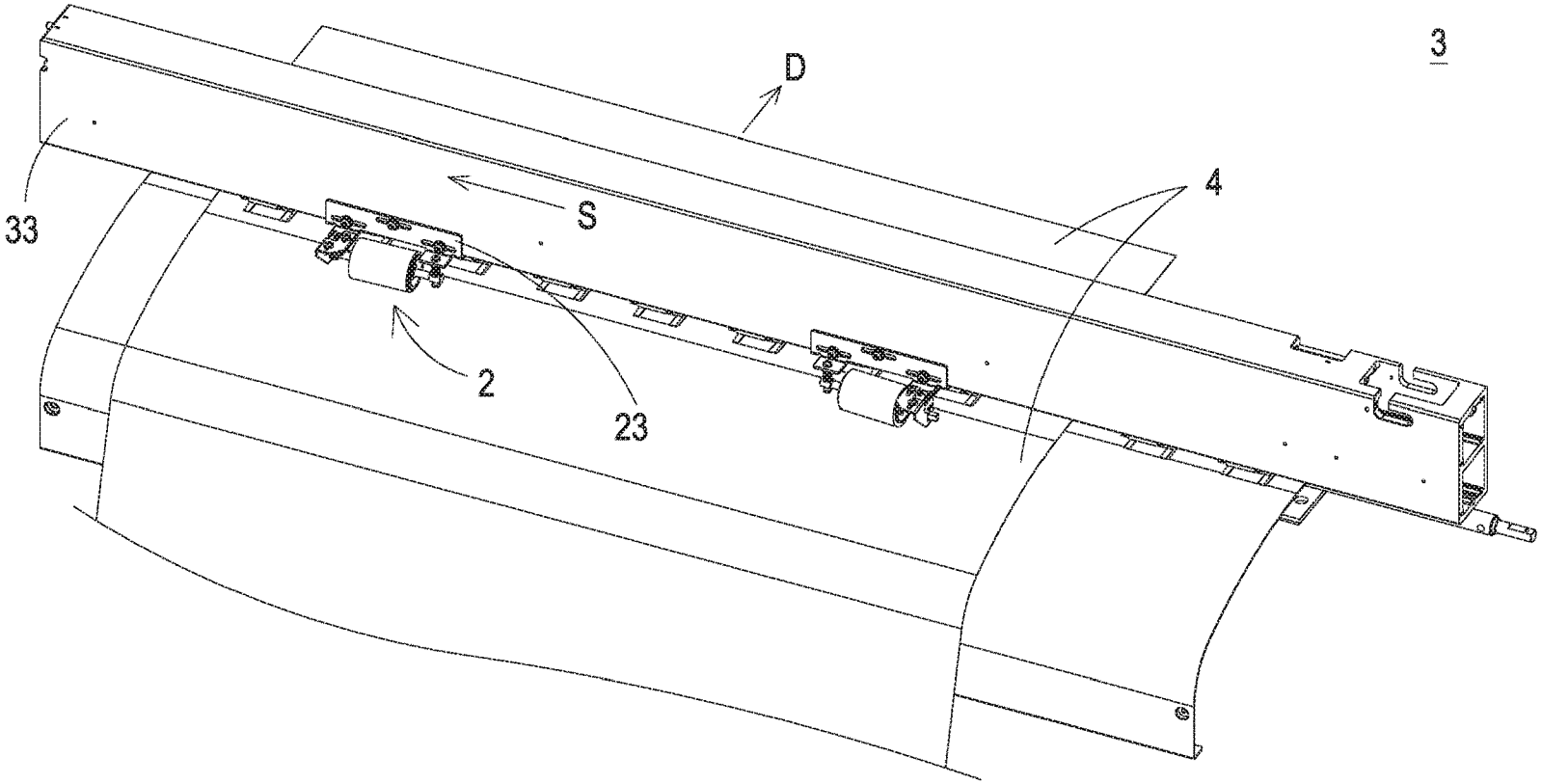
FIG. 5 schematically illustrates the installation of a roller-type lateral force generation device of the present invention on a print apparatus.

Please refer to FIG. 4 and FIG. 5. FIG. 4 schematically illustrates the partial structure of a roller-type lateral force generation device and the relation of a paper-feeding roller, a paper-feeding roller shaft, a paper and the transport direction thereof. FIG. 5 schematically illustrates the installation of a roller-type lateral force generation device of the present invention on a print apparatus. As shown in FIG. 4 and FIG. 5, a roller-type lateral force generation device 2 of the present invention is preferably applied to provide a lateral force while a print apparatus 3 transporting a paper 4 along a paper-feeding direction D. The roller-type lateral force generation device 2 is disposed along a set direction S, which is perpendicular to the paper-feeding direction D. That is, the set direction. S is also the direction of a paper-feeding roller shaft 31 itself. Active rollers 32 on the paper-feeding roller shaft 31 are continuously driven to generate a paper-feeding trend T1 that makes the paper 4 move forward along the paper-feeding direction D, so the lateral force pulling outward is generated through the difference between the paper-feeding trend T1 and a guiding trend T2 generated by the roller-type lateral force generation device 2 of the present invention. These are the main principle of the present invention.

Figure 6:
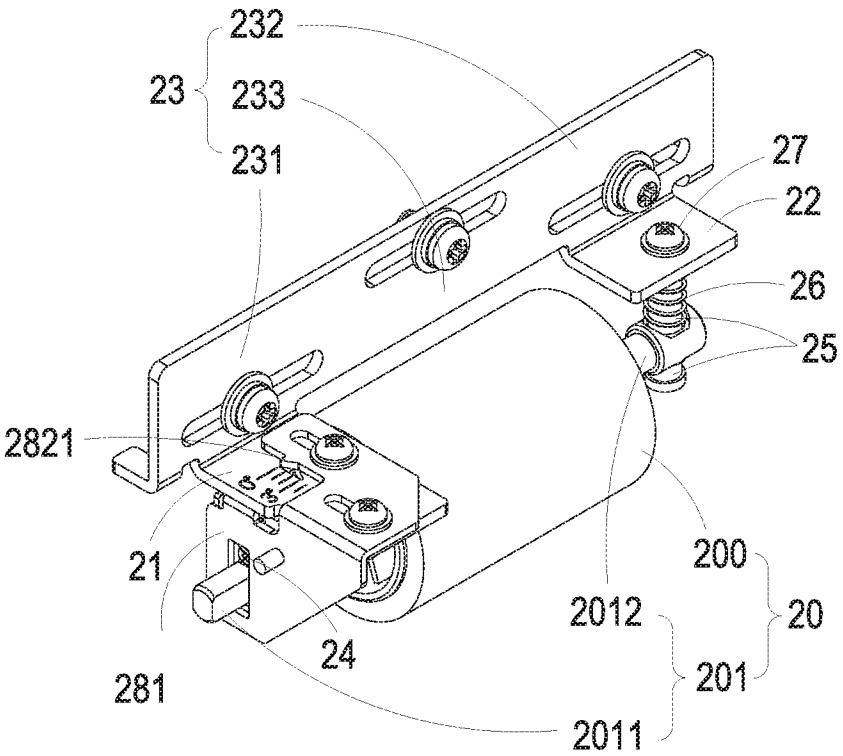
FIG. 6 schematically illustrates the structural view of a roller-type lateral force generation device according to an embodiment of the present invention.
Figure 7:
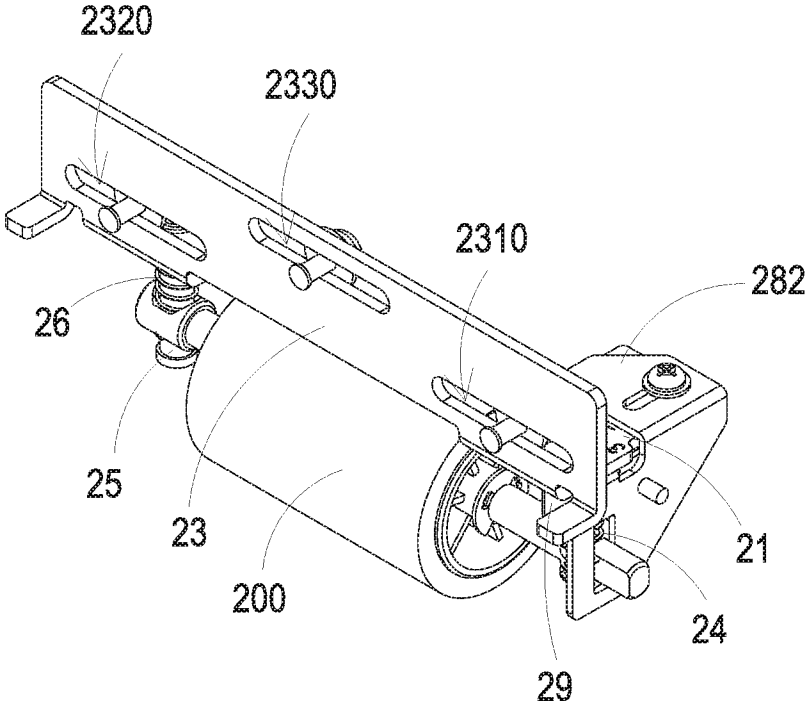
FIG. 7 schematically illustrates another structural view of a roller-type lateral force generation device according to an embodiment of the present invention.
Figure 8:
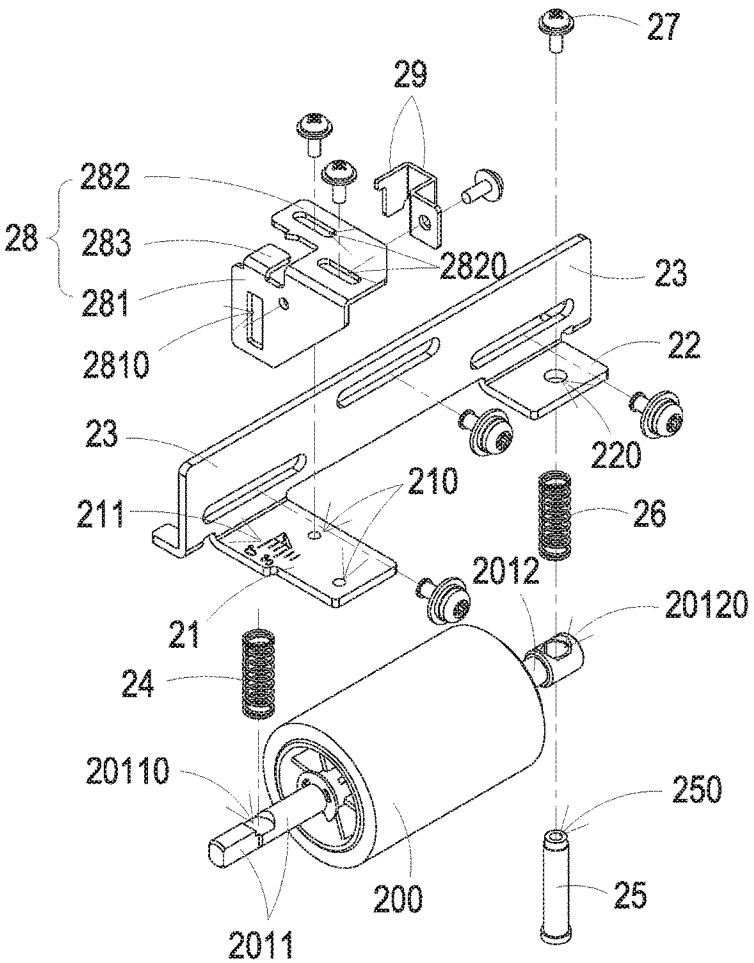
FIG. 8 schematically illustrates the exposed view of a roller-type lateral force generation device according to an embodiment of the present invention.

Please refer to FIG. 5, FIG. 6, FIG. 7 and FIG. 8. FIG. 6 schematically illustrates the structural view of a roller-type lateral force generation device according to an embodiment of the present invention. FIG. 7 schematically illustrates another structural view of a roller-type lateral force generation device according to an embodiment of the present invention. FIG. 8 schematically illustrates the exposed view of a roller-type lateral force generation device according to an embodiment of the present invention. As shown in FIG. 5, FIG. 6, FIG. 7 and FIG. 8, a roller-type lateral force generation device 2 of the present invention includes a roller 20, a first plate 21, a second plate 22, a connection plate 23, a first spring 24, a rotation shaft 25, a second spring 26, a fixing element 27 and an adjustment element 28. The roller 20 has a main body 200 and a roller shaft 201. The roller shaft 201 is penetrated through the main body 200. The roller shaft 201 has a first shaft portion 2011 and a second shaft portion 2012 respectively at the two sides of the main body 200. The second shaft portion 2012 has a penetration hole 20120. The first plate 21 is disposed above the first shaft portion 2011. The second plate 22 is disposed above the second shaft portion 2012. The second plate 22 has an opening 220. The opening 220 is corresponded to the penetration hole 20120 along a vertical direction (perpendicular to the ground). The connection plate 23 is connected with the first plate 21 and the second plate 22. The connection plate 23 is disposed along a set direction S, and the set direction S is perpendicular to the paper-feeding direction D. The connection plate 23 may be disposed on a frame 33 of the print apparatus 3, but not limited thereto.

The first spring 24 is disposed between the first plate 21 and the first shaft portion 2011. The rotation shaft 25 is penetrated through the penetration hole 20120. The second spring 26 is disposed between the second plate 22 and the second shaft portion 2012 and sleeved around the rotation shaft 25. The fixing element 27 is partially penetrated through the opening 220, the rotation shaft 25 and the second spring 26. The adjustment element 28 has a limitation plate 281. The limitation plate 281 is perpendicular to the first plate 21. The limitation plate 281 has a limitation groove 2810. The first shaft portion 2011 is penetrated through the limitation groove 2810. The set direction S and a connection line of the rotation shaft 25 and the roller shaft 201 have an angle θ, which is larger than 0 degree. The main body 200 of the roller 20 is pressed downwardly by the elastic power of the first spring 24 and the second spring 26, so that the lateral force is generated while the paper being fed through the bottom of the main body 200 of the roller 20. Therefore, the paper 4 can be forced outward while being fed forward to prevent inward shrinkage, and further the skewed issue during the paper transport can be solved.

In some embodiments, the fixing element 27 may be a screw, and the rotation shaft 25 may have a screw hole 250. The fixing element 27 is fixed with the screw hole 250. In addition, the rotation shaft 25 is preferred to be perpendicular to the roller shaft 201, and the second spring 26 is abutted against the second plate 22 and the second shaft portion 2012, but not limited herein. In some embodiments, the first shaft portion 2011 of the roller shaft 201 has an accommodation groove 20110. The first spring is disposed in the accommodation groove 20110, but not limited herein.

In some embodiments, the connection plate 23 has a first end portion 231, a second end portion 232 and a central portion 233. The central portion 233 is connected with the first end portion 231 and the second end portion 232, the first end portion 231 is preferably connected with the first plate 21, the second end portion 232 is preferably connected with the second plate 22, and the central portion 233 is preferably corresponded to the main body 200, but not limited thereto. The first end portion 231, the second end portion 232 and the central portion 233 each has an auxiliary positioning groove, i.e. the auxiliary positioning groove 2310 of the first end portion 231, the auxiliary positioning groove 2320 of the second end portion 232 and the auxiliary positioning groove 2330 of the central portion 233, and the lengths of the auxiliary positioning groove 2310, the auxiliary positioning groove 2320 and the auxiliary positioning groove 2330 are the same.

In some embodiments, the first plate 21 has two holes 210, the adjustment element 28 further has an adjustment plate 282, the adjustment plate 282 is perpendicular to the limitation plate 281, the adjustment plate 282 has two floating grooves 2820, and the two floating grooves 2820 are respectively corresponded to the two holes 210 along the vertical direction mentioned above. In some embodiments, the adjustment element 28 further has a abutting plate 283. The abutting plate 283 is perpendicular to the limitation plate 281 and parallel to the adjustment plate 282. The abutting plate 283 is corresponded to the limitation plate 281 along the vertical direction. The first spring 24 is abutted against the first shaft portion 2011 and the abutting plate 283, and the first plate 21 is disposed between the abutting plate 283 and the adjustment plate 282, but not limited herein.

In some embodiments, the roller-type lateral force generation device 2 of the present invention further includes a spring position-limiting element 29. The spring position-limiting element 29 is connected with the limitation plate 281, and the first spring 24 is covered by the abutting plate 283, the limitation plate 281, the first shaft portion 2011 and the spring position-limiting element 29. Moreover, the first plate 21 is provided with an angle scale 211. The adjustment plate 282 further has a tip portion 2821. The tip portion 2821 is corresponded to the angle indicated by the angle scale 211, which is equal to the angle θ. In other words, since the adjustment plate 282 of the adjustment element 28 is for example screwed through the floating groove 2820 into the hole 210, the angel θ may be adjusted only through adjusting the adjustment plate 282 of the adjustment element 28 to move along the floating groove 2820. That is, the roller 20 is rotated slightly around the rotation shaft 25, and the actual angle θ can be known through viewing the angle scale 211.

Figure 9:
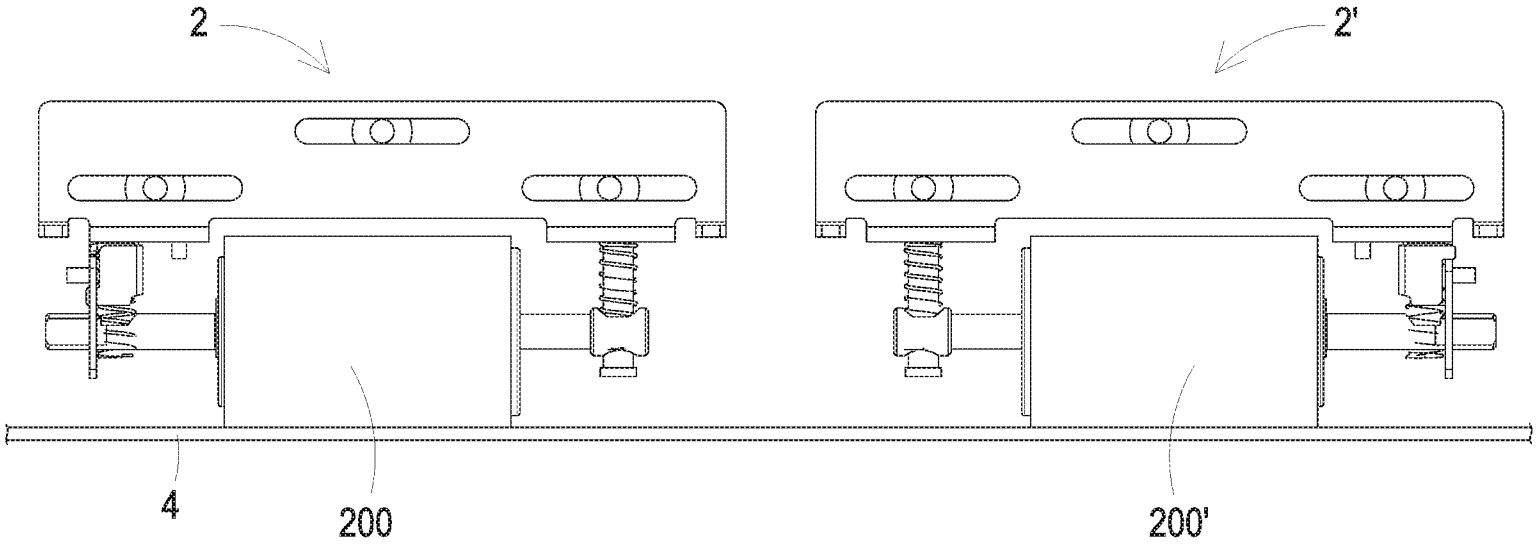
FIG. 9 schematically illustrates a pair of symmetric roller-type lateral force generation devices providing the lateral forces to a paper.

Please refer to FIG. 4, FIG. 5 and FIG. 9. FIG. 9 schematically illustrates a pair of symmetric roller-type lateral force generation devices providing the lateral forces to a paper. As shown in FIG. 4, FIG. 5 and FIG. 9, the roller-type lateral force generation devices 2 are preferred to be installed on the print apparatus 3 as pairs of the roller-type lateral force generation devices. For example, a roller-type lateral force generation device 2 and a roller-type lateral force generation device 2', which are symmetric to each other or have the mirror or symmetric configuration, may be installed on the symmetric positions corresponded to the paper 4. When the paper 4 is transported through the bottom of the main body 200 of the roller-type lateral force generation device 2 and the bottom of the main body 200' of the roller-type lateral force generation device 2', the lateral forces are provided. It should be noted that the guiding trend T2' shown in FIG. 4 is also symmetric to the guiding trend T2.

The roller-type lateral force generating device 2 described in the present invention is used to provide the lateral force through the rollers. However, the method or the structure utilizing such a technique is not limited to the above embodiment. The realization of the present invention is that it is easy to modularize the mechanism so as to be added into the existing print apparatus. It can also be integrated directly into the paper-feeding roller in order to make the paper-feeding roller a roller with a finely adjustable angle without the addition of means. The function will be more direct and obvious. However, since the structure is complex, the design must be more careful. Anyway, this application method is still an extension of the teaching and suggestions of the present invention.

Figure 10:
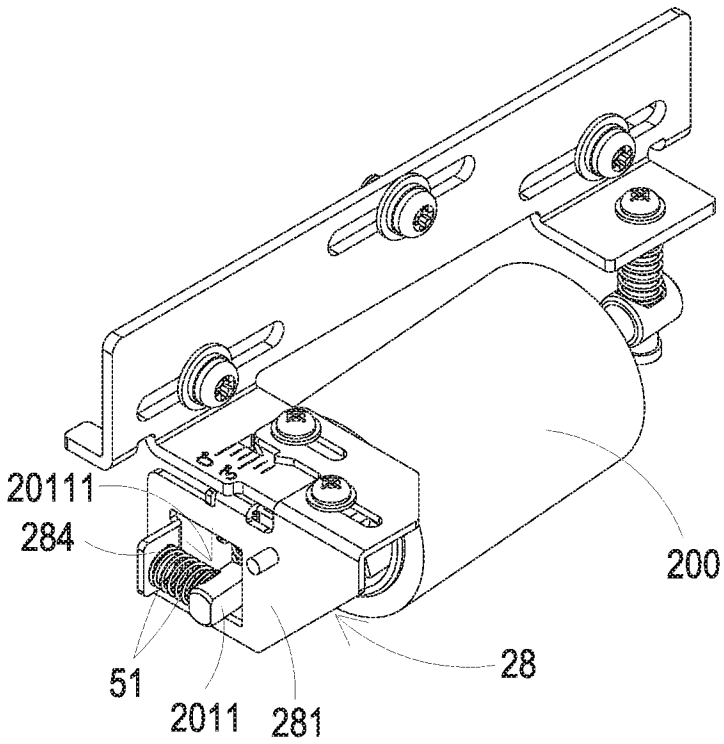
FIG. 10 schematically illustrates the structural view of a roller-type lateral force generation device according to another embodiment of the present invention.
Figure 11:
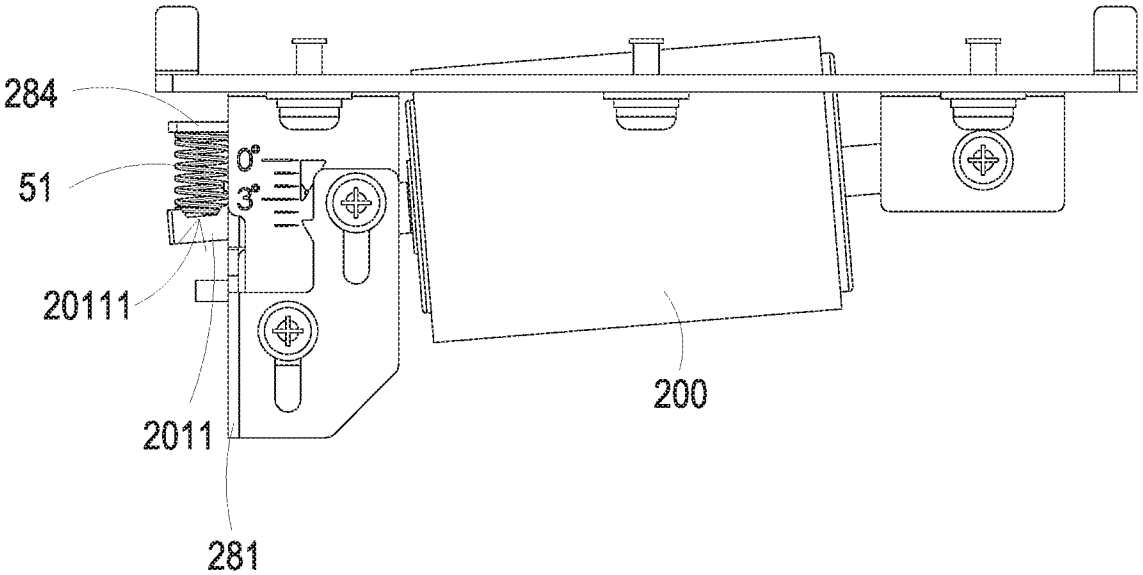
FIG. 11 schematically illustrates the top view f the roller-type lateral force generation device shown in FIG. 10.

Please refer to FIG. 10 and FIG. 11. FIG. 10 schematically illustrates the structural view of a roller-type lateral force generation device according to another embodiment of the present invention. FIG. 11 schematically illustrates the top view of the roller-type lateral force generation device shown in FIG. 10. As shown in FIG. 10 and FIG. 11, the roller-type lateral force generating device 2 further includes a third spring 51. The adjustment element 28 further includes a buffer plate 284. The first shaft portion 2011 has a buffer groove 20111. The buffer plate 284 is extended from the limitation plate 281 towards a direction away from the main body 200, the buffer groove 20111 is exposed outside the limitation plate 281, and the third spring 51 is disposed in the buffer groove 20111 and abutted against the buffer groove 20111 and the buffer plate 284. In this embodiment, the third spring 51 is disposed at a positioning that pushes the main body 200 to form the angle θ. The third spring 51 has the buffer function. It is an object that when the lateral force is large enough to compress the third spring 51, the third spring 51 will be compressed and the angle θ will be smaller. The lateral force is then weakened until the elastic power and the lateral force becoming balanced. Therefore, the paper is avoided from being torn. This design is an alternative embodiment of the present invention and therefore belongs to the teachings and suggestions of the present inventions.

From the above description, the present invention provides a roller-type lateral force generation device. By disposing the connection plate along the direction of the paper-feeding roller shaft itself, an angular difference is existed between the main body of the roller and the paper-feeding roller shaft, and the lateral force, which is existed in form of friction force, is provided through the angular difference. The paper can be forced outward while being fed forward to prevent inward shrinkage, and further the skewed issue during the paper transport can be solved. Meanwhile, since the main body of the roller is pressed by the first spring and the second spring so as to be contacted with the paper and driven to be rotated, the roller-type lateral force generation device is applied to each type of the present print apparatus without extra power source. The roller-type lateral force generation device of the present invention with high compatibility can be widely utilized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A roller-type lateral force generation device, providing a lateral force while a print apparatus transporting a paper along a paper-feeding direction, the roller-type lateral force generation device comprising:

a roller having a main body and a roller shaft, wherein the roller shaft is penetrated through the main body and having a first shaft portion and a second shaft portion respectively at the two sides of the main body, and the second shaft portion has a penetration hole;

a first plate disposed above the first shaft portion;

a second plate disposed above the second shaft portion, wherein the second plate has an opening, and the opening is corresponded to the penetration hole;

a connection plate connected with the first plate and the second plate, wherein the connection plate is disposed along a set direction, and the set direction is perpendicular to the paper-feeding direction;

a first spring disposed between the first plate and the first shaft portion;

a rotation shaft penetrated through the penetration hole;

a second spring disposed between the second plate and the second shaft portion and sleeved around the rotation shaft;

a fixing element partially penetrated through the opening, the rotation shaft and the second spring; and an adjustment element having a limitation plate, wherein the limitation plate is perpendicular to the first plate, the limitation plate has a limitation groove, and the first shaft portion is penetrated through the limitation groove, wherein the set direction and a connection line of the rotation shaft and the roller shaft have an angle larger than 0 degree, and the main body of the roller is pressed by the elastic power of the first spring and the second spring, so that the lateral force is generated while the paper being fed through the bottom of the roller.

2. The roller-type lateral force generation device according to claim 1, wherein the rotation shaft is perpendicular to the roller shaft, and the second spring is abutted against the second plate and the second shaft portion.

3. The roller-type lateral force generation device according to claim 1, wherein the first shaft portion has an accommodation groove, and the first spring is disposed in the accommodation groove.

4. The roller-type lateral force generation device according to claim 3 further comprising a third spring, wherein the adjustment element further comprises a buffer plate, the first shaft portion has a buffer groove, the buffer plate is extended from the limitation plate towards a direction away from the main body, the buffer groove is exposed outside the limitation plate, and the third spring is disposed in the buffer groove and abutted against the buffer groove and the buffer plate.

5. The roller-type lateral force generation device according to claim 1, wherein the connection plate has a first end portion, a second end portion and a central portion, the central portion is connected with the first end portion and the second end portion, the first end portion is connected with the first plate, and the second end portion is connected with the second plate.

6. The roller-type lateral force generation device according to claim 5, wherein the first end portion is perpendicular to the first plate, the second end portion is perpendicular to the second plate, and the central portion is corresponded to the main body.

7. The roller-type lateral force generation device according to claim 5, wherein the first end portion, the second end portion and the central portion each has an auxiliary positioning groove, and the length of each auxiliary positioning groove is the same as each other.

8. The roller-type lateral force generation device according to claim 1, wherein the first plate has two holes, the adjustment element further has an adjustment plate, the adjustment plate is perpendicular to the limitation plate, the adjustment plate has two floating grooves, and the two floating grooves are respectively corresponded to the two holes.

9. The roller-type lateral force generation device according to claim 8, wherein the adjustment element further has a abutting plate, the abutting plate is perpendicular to the limitation plate and parallel to the adjustment plate, the abutting plate is corresponded to the limitation plate, the first spring is abutted against the first shaft portion and the abutting plate, and the first plate is disposed between the abutting plate and the adjustment plate.

10. The roller-type lateral force generation device according to claim 9 further comprising a spring position-limiting element, wherein the spring position-limiting element is connected with the limitation plate, and the first spring is covered by the abutting plate, the limitation plate, the first shaft portion and the spring position-limiting element.

* * * * *